US005836816A

United States Patent [19]

Bruin et al.

[11] Patent Number: 5,836,816

[45] Date of Patent: Nov. 17, 1998

[54] GAME OF CHANCE

[75] Inventors: Wim Bruin; Edward E. E. Frietman; Ton Grootens, all of The Hague, Netherlands

[73] Assignee: Tosso B.V., The Hague, Netherlands

[21] Appl. No.: 676,119

[22] PCT Filed: Feb. 7, 1994

[86] PCT No.: PCT/NL94/00033

§ 371 Date: Jul. 12, 1996

§ 102(e) Date: Jul. 12, 1996

[87] PCT Pub. No.: WO95/21425

PCT Pub. Date: Aug. 10, 1995

[51] Int. Cl.[6] ..... A63F 9/00

[52] U.S. Cl. ..... 463/16

[58] Field of Search ..... 463/16

[56] References Cited

U.S. PATENT DOCUMENTS 4,842,278 6/1989 Markowicz ..... 273/138 A 5,106,089 4/1992 Wood ..... 273/139

5,269,523 12/1993 Boylan et al. ..... 273/138 R

FOREIGN PATENT DOCUMENTS 1 428 157 3/1976 United Kingdom .

2 256 519 12/1992 United Kingdom .

*Primary Examiner*—William H. Grieb

*Attorney, Agent, or Firm*—Young & Thompson

[57] ABSTRACT

The present invention is based on a game of chance wherein a player selects a combination of say (m) play symbols out of a collection of say (n) play symbols where (m)≦(n). A set of say (m) winning play symbols is randomly selected and next compared to the combination of say (m) play symbols chosen by the player. The by a player selected (m) play symbols are previously marked, registered and printed on a bet slip.

18 Claims, 5 Drawing Sheets

GAME OF CHANCE

TECHNICAL FIELD

The invention relates to the field of games of chances and in particular, it relates to games of chances where a player selects symbols and/or letters and/or a combination of symbols and letters that are appointed later in a random drawing. Among the classes of games of chances are e.g. lotto and casino games, horse- and car races.

BACKGROUND OF THE INVENTION

Traditionally, games of chances such as lotto and pick games have been played by randomly drawing play symbols. The collection of play symbols could be numerals and/or letters and/or combinations of the two.

Systems that determine winning play symbols are various; such as there are techniques to repeatedly drawing objects, like balls that display different numerals or letters, or dices that are thrown during a play at a casino, or random chosen numerals or letters or combinations of the two that are displayed on an indicator screen, or announcing winning numbers of horses or cars that won a race.

From U.S. Pat. No. 5,106,089 a method of playing a pick (m) or pick (p)((m)≠(p)) game is known, in which a player first selects (m) or (p) numerals or letters or combinations of the two. Drawings of the (m) numerals or letters or combinations of the two can be either held off-line at a central location or displayed real-time on a large indicator screen during, for example, a Television show, or announced during a play at a casino.

During a game (n) balls are mixed in a mostly transparent rotating globe. The globe is connected to a mechanism of (m) receptacles ((m)s(n)) that accept one ball at the time. After the first randomly selected ball has fallen in the most right of (m) receptacles the mechanism will move up one place to the right. The system is now ready to accept the next randomly chosen ball. This action continues until (m) shifts to the right have been made. The sum of the set of (m) balls constitutes the winning number. If the number of the sum selected by the player is identical to the number of the sum (S) of the (m) numerals drawn from the globe, the player wins the game.

The amount of money won by a player, usually set for each game separately, is based on the probability of selecting the winning sum number (S) that is composed of the sum, of (m) randomly chosen numerals and the total amount of money composed of the stakes of the wagers.

SUMMARY OF THE INVENTION

One of the objects of this invention is to provide a method of playing a game of chance wherein a set of say (m) winning play symbols are first randomly selected from a collection of say (n) play symbols, after which the sum (S) is appointed. A play symbol is hereinafter defined as any type of symbol which can be used in a game of chance such as functional symbols (like indicia of articles of use), playing cards, numerals, letters and/or combinations of them all.

The word "player" in the description of this invention includes the notion "multiple players" as well. It therefore suffices to use the notion "a or the player".

A priory a player selects a number or other play indicia from a first set of play indicia, each play indicia representing a combination of say (m) play symbols taken from the set of say (n) play symbols. After the player has selected the number or other play indicia a set of winning play symbols is randomly selected from a collection of play symbols by a drawing. Upon drawing of the winning play symbols, the player compares his bet which he selected to the winning play symbols to determine if he has won the game.

The possible bets are increased in that in case a winning combination of say (m) play symbols taken from the set of say (n) play symbols results in the drawing of the play symbol that proceeds from the combination of the maximum number of possibilities to compose (m) combinations of play symbols out of the set of say (n) play symbols, the game of chance requires an additional drawing of say (v) further play symbols taken from the set of say (w) further play symbols ($1 \leqq (v) < (w)$) to decrease the chance of winning.

Consequently, a player may select a further play indicia from a second set of play indicia. Each further play indicia represents a further combination of play symbols being not used in the first set of play indicia, and one or more winning further play symbols.

Preferably the further combination of play symbols being not used in the first set of play indicia have the highest probability of being drawn.

An example of the method such as a "Summing Up 8-out of-16 numbers lottery" is dedicated to the work-out of two alternatives during which the winning sum (S) of (m) randomly chosen play symbols will be made public by using the television as a medium. In the two alternatives different kinds of play symbols will be merged.

The first alternative is completely related to a horse- or car-race, of which the course of the race is rurally broadcasted. The procedure at the race-course itself, here focused on a horse-race, is as follow. The names of (n) participating horses are announced previously. The in this example (n) numbers are yet randomly distributed among the horsemen just before the start of the race.

The numbers of the first (m)((m)≦(n)) incoming horses, out of a total of (n) participating horses, are illuminated on an indicator panel. The sum (S) of the first (m) horses constitutes the winning number.

A player wins the game if the number of the sum indicated on his bet slip coincides with the number of the sum (S) appointed by the (m) numerals of the (m) first incoming horses.

The procedure of the second alternative is identical to the one described above, except for the fact that only the first (q)((q)<(m))numbers of the incoming horses out of a total of (n) participating horses are announced. The numbers of the first (q)((q)<(m)) incoming horses are illuminated on an indicator panel containing (n) separate to be illuminated indicators. In order to be able to appoint a sum (S) out of (m) numerals, the remaining (m–q) numbers have to be obtained using different play symbols. The remaining (m–q) numbers can be either appointed by repeatedly drawing balls or by successively selecting (m–q) illuminating indicators in a random sequence out of an indicator panel containing (n) indicators. In both cases the to be selected numbers are different from the already announced (q) numerals of the first incoming horses, implying that the (q) known numerals are excluded from the drawings. Successively selecting the remaining (m–q) illuminating indicators in a random sequence out of an indicator panel containing (n) indicators could be part of a Television show that is locally attended by players as well as rurally broadcasted.

The "Summing Up 8-out of-16 numbers lottery" extends the invention with a chess-board like indicator panel, in which the set of squares represents all possible sums (S)

derived from the $\binom{n}{m}$ possible combinations. The complete collection of squares, representing all possible sums (S) derived from the $\binom{n}{m}$ combinations are illuminated at the very beginning of the game.

A method suitable for playing the "Summing Up 8-out of-16 numbers lottery" invention, indicating a sum of numbers by putting out the indicator or indicators that correspond(s) with a sum (S) or multiple sums (S) that cannot be composed any more given the first $(r)(1 \leqq (r) \leqq (m))$ randomly chosen numbers out of a total of (m) $((m) \leqq (n))$ randomly selected numerals, is proposed. The phenomenon thus demonstrates a putting out instead of a lighting up of indicators, which sequence is determined by the exclusions of possible sums (S). The final result demonstrates an indicator panel in which all indicators are put out except for one.

A player wins the game if the number of the sum indicated on his bet slip coincides with the only illuminated number at the indicator panel.

A second object of the present invention is the provision of a play slip wherein one or more play indicia representing combinations of possible play symbols to be drawn in a game are selected by a player. In one configuration of the invention where the play symbols are numerals, winning indicia which represent the sum(s) selected by a player of possible numbers to be drawn are marked, registered, dated, localised and printed on the play slip.

The play slip has at least one bet indicia to be marked by the player, registered by an appropriate game controller and printed at a sales office indicating a number which represents a predetermined mathematically combination such as the sum of the winning numbers. In addition, time, place, date, selection of sum number(s) indicia are printed at the bottom of the play slip prior to the random selection of the winning numbers. A pay indicia indicating the total costs for the associated play (bet) indicia is also provided on the bet slip as well as other indicia for classification and registration purposes.

A third object of the present invention is to provide a new criteria, presenting combinations of winning play symbols that can be solely the result of a horserace match or a combination of a set of repeatedly drawing balls and the result of a horse-race match or a set of repeatedly drawing balls and the result of a horse-race match and the result of randomly illuminating indicators in an indicator panel.

The fourth object of the present invention is the provision of a game technique in which the results of winning play symbols are not indicated by lighting up the indicators in an indicator panel but just exploring the opposite phenomenon in which indicators are put out.

The fifth object of the present invention is the presentation of an innovative chess-board like indicator panel, representing a score-board where the results of the winning play symbols are indicated as squares of a chess-board.

DETAILED DESCRIPTION OF THE INVENTION

Figure 1:
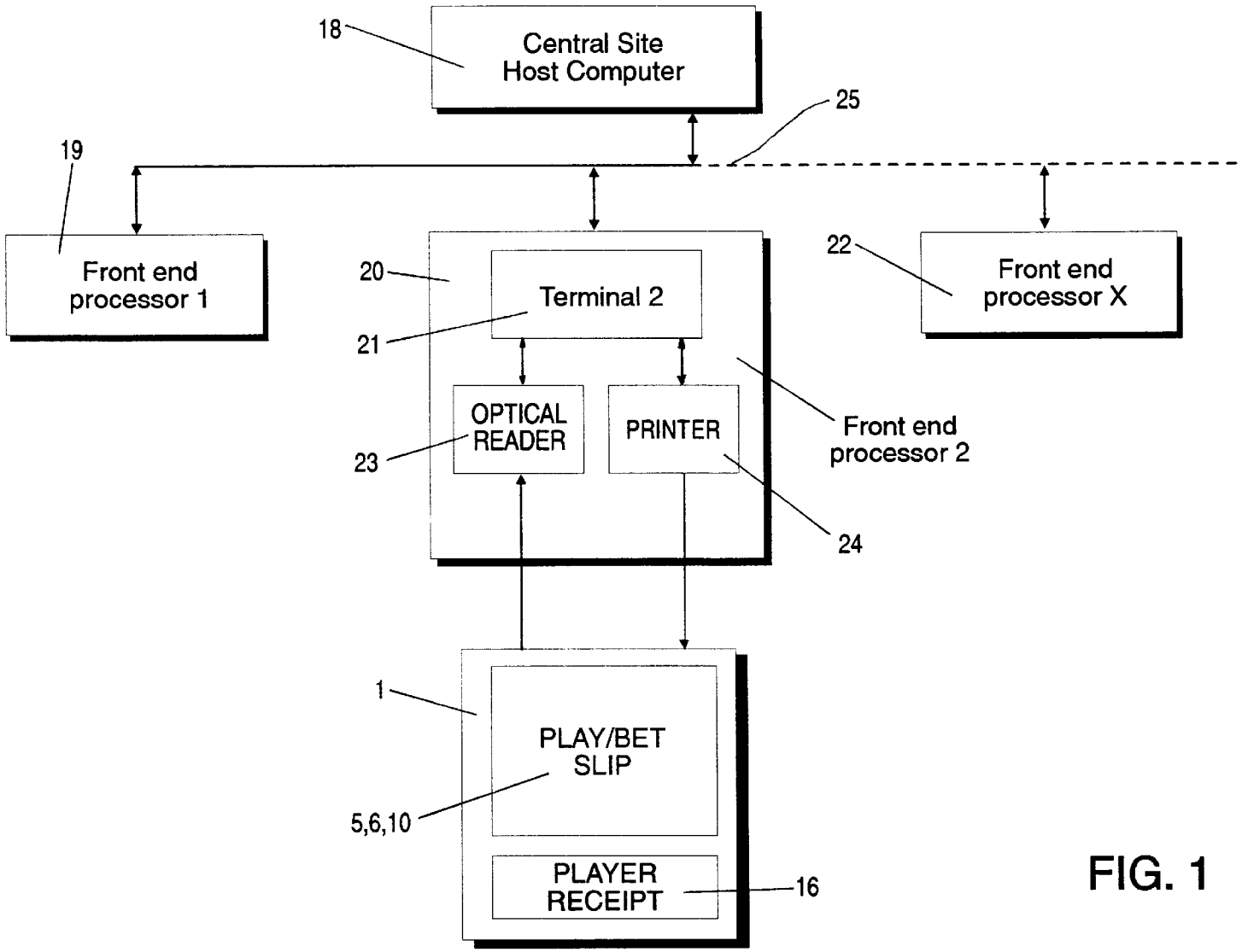
FIG. 1 is a block diagram illustrating the method of playing the "Summing Up 8-out of-16 numbers lottery"

FIG. 1 represents a conventional set-up of hardware systems to play the "Summing Up 8-out of-16 numbers lottery" according to an embodiment of the present invention. The block diagram in FIG. 1 shows a number of front end processors 1, 2, . . . X, indicated by the numbers 19, 20 and 22, that are connected to a Central Site Host Computer 18 through a Local- [LAN] or Wide-Area-Network [WAN] 25. Any arbitrary number of front end processors X, placed at player's disposal to mark, date and register a selection of his appointed play symbols, can be provided by the game controller depending upon such factors as location and frequency of use.

For the purpose of a detailed description of the "Summing Up 8-out of-16 numbers lottery", each front end processor 19, 20 and 22 illustrated in FIG. 1 directly corresponds to the architecture of member 20. At front end processors 1, 2, . . . X a player lays a wager on the basis of his selection of one or multiple play symbols. Each front end processor 1, 2, . . . and X, driven by a software algorithm that reads, classifies, characterises and prints the combination of indicia's indicated as 5 and/or 6 and/or 10 selected by the player, consists of a Terminal 21, an Optical Reader 23 and a Printer 24.

The player uses a play slip 1 which he inserts into the Optical Reader 23 to play the "Summing Up 8-out of-16 numbers lottery" lottery. After a connection has been made with the Central Site Host Computer 18 through the LAN or WAN connection 25, date, time, place, selection of play symbols, dues paid and other indicia [UAC] are registered at the Central Site Host Computer 18. An exact replica of the date 11, time 14, place 15, selection of play symbols 12, dues paid 13 and other indicia 17, that is thus a priory registered and stored at the Central Site Host Computer 18, is locally made available to the player by providing him with a player receipt 16 that has been printed by the Printer 24.

Figure 2:
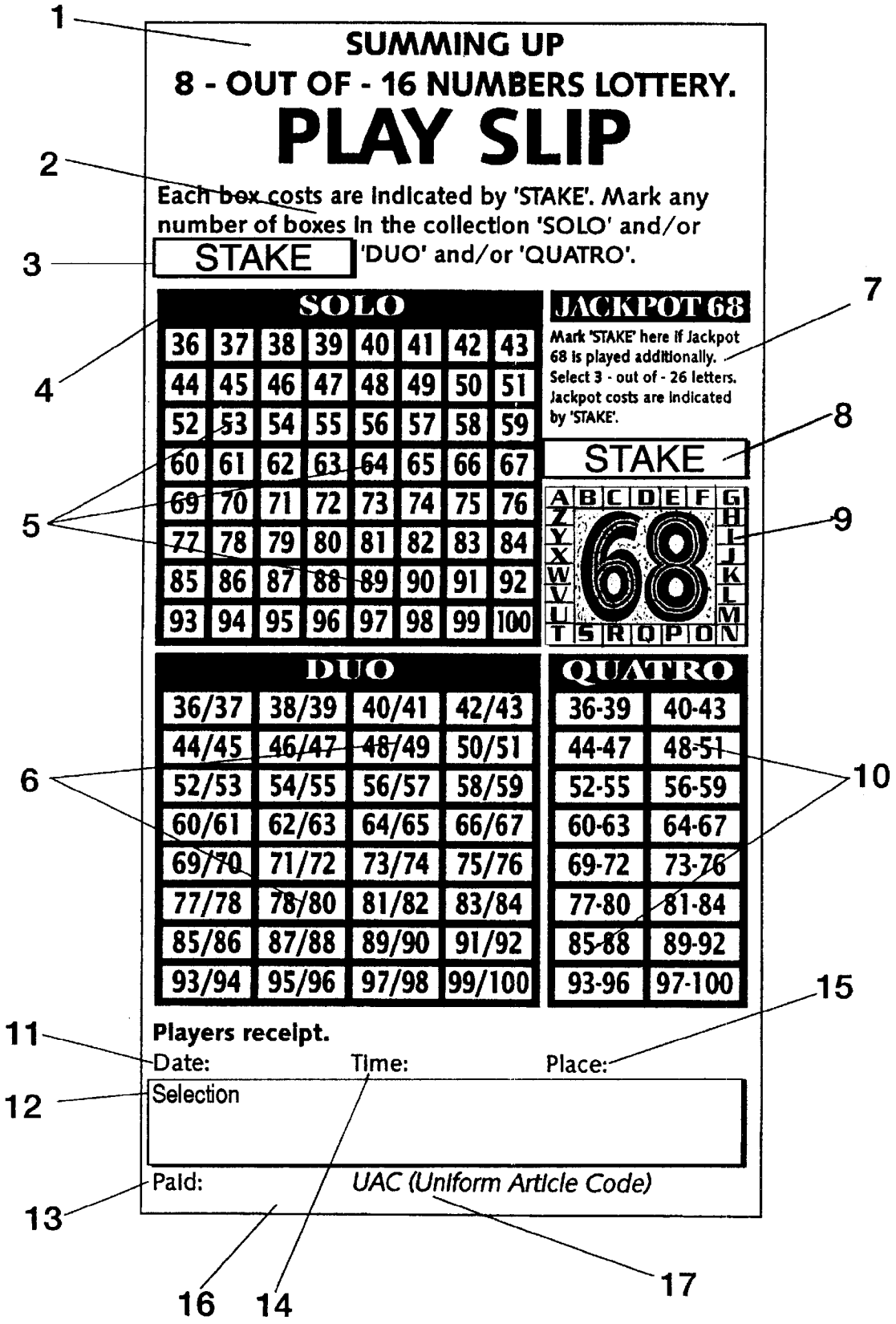
FIG. 2 is a plan view of the play slip of the present "Summing Up 8-out of-16 numbers" invention, marked with references 1, 2, . . . 17 among which date 11, time 14, place 15, selected number(s) 12, costs indicia labelled "Paid" 13 and an Uniform Article Code 17 to classify and register this particular lay slip.

In the embodiment of the invention Illustrated in FIG. 2 a survey is first given of all the play symbols, here represented by numbers and letters, that can be selected at the play slip when playing the "Summing Up 8-out of-16 numbers lottery". The collection of the singular numbers (36, 37, . . . 67, 69, . . . 99, 100) labelled "SOLO" proceeds from a mathematical operation of the sum of the 8-out of-16 winning numbers. The number combinations indicated at the "DUO" and "QUATRO" section are derivatives of the singular numbers indicated at the "SOLO" section in that they respectively combine two (36/37 . . . 66/67, 69/70 . . . 99/100) and four (36–39, . . . 64–67, 69–72 . . . 97–100) of the adjoining numbers. In addition to the "SOLO", "DUO" and "QUATRO" collection is a "JACKPOT 68" section that combines a single number 68 with all the characters (A, B, C, . . . Y, Z) of the alphabet.

The embodiment of the invention illustrated in FIG. 2 is used to explain the details of the rules of the "Summing Up 8-out of-16 numbers lottery". To play the "Summing Up 8-out of-16 numbers lottery" eight numbers are randomly drawn out of a total of sixteen. In the "SOLO" section the sum of respectively the lowest numbers one-through-eight and the highest numbers nine-through-sixteen is calculated for 36 and 100. The numerals 36 and 100 are located diagonals-wise at the comers of the 8-by-8 matrix 4. In between the two extremes of 36 and 100 are sixty-three other numbers of increasing value (37, 38, . . . 67, 69 . . . 98, 99), the frequency of occurrence of each of the numbers is arranged according to a Gaussian distribution. The probability of occurrence of the number 68 is the greatest. The twenty-six letters of the alphabet, surrounding the number 68, are joined to compensate for the higher probability of occurrence of the numeral 68 with respect to all the other numbers. After marking the box labelled "STAKE" 3, indicated at the upper left part of FIG. 2, the player checks one or multiple boxes 5 and/or 6 and/or 10 on his play slip 1. The numbers indicated at boxes 5 and/or boxes 6 and/or boxes 10 correspond respectively to the categories "SOLO" and/or "DUO" and/or "QUATRO". In case the player should decide to include "JACKPOT 68", the box labelled "STAKE" 8 at the right side of FIG. 2 should be marked also. In his selection to play "JACKPOT 68", the player additionally marks three letters 9 in a random sequence out of a total of twenty-six letters composing the alphabet. Explanatory text 2 and 7 explains the player the rules of the "Summing Up 8-out of-16 numbers lottery". It also assists in the appointment of the height of the stakes of his bets.

Next a notification of the selection out of boxes 5 and/or 6 and/or 10 and/or 9, marked by the player and indicated on the play slip 1 as player's bets, has to be registered at the game controller or at the local sales offices. He therefore inserts his play slip 1 into the Optical Reader 23 of a front end processor 20 situated at either a local sales office or at the game controller.

The information, concerning date 11, time 14, place 15, selection of play symbols 12, dues paid 13 and other indicia 17, is first stored in the main memory of the Central Site Host Computer 18. An exact replica of what has been sent to the Central Site Host Computer 18 is now provided to the player by printing the indicia in on the "PLAYER RECEIPT" 16 at the bottom of the play slip 1, using Printer 24.

Depending upon "SOLO" and/or "DUO" and/or "QUATRO" being played, a win always represents the sum of eight randomly chosen winning numerals. The winning indicia are appointed by the collection of the singular numbers (36, 37, . . . 67, 69, . . . 99, 100) in the case of "SOLO" 5 and/or a combination of two numbers (36/37 . . . 66/67, 69/70 . . . 99/100) in the case of "DUO" 6 and/or a combination of four adjoining numbers (36–39, . . . 64–67, 69–72 . . . 97–100) in the case of "QUATRO" 10.

In the case of "JACKPOT 68" being played, a win is dependent upon the selection of the number 68 as the sum of the eight randomly chosen winning numerals, expanded with a selection of three randomly chosen winning letters 9 out of the twenty-six letters that composes the alphabet.

For the "Summing Up 8-out of-16 numbers lottery" results, the drawing of the eight randomly chosen numbers composing a sum of winning numerals eventually expanded with the drawing of three randomly chosen winning letters shall be announced during a life broadcast through Television.

Upon randomly drawing of the eight numerals, composing the winning sum, eventually expanded with a set of three winning letters in case the winning sum is 68, the player compares the bet indicia on his play slip 1 to the combination of the winning numerals and/or letters as shall be announced during a life broadcast of the "Summing Up 8-out of-16 numbers lottery" game. If the player's bet matches the combination of winning numerals and/or letters, the player wins an amount of money indicated in pay-indicia by the game controller and he then can redeem the play combination slip for payment of the specified amount.

Figure 3:
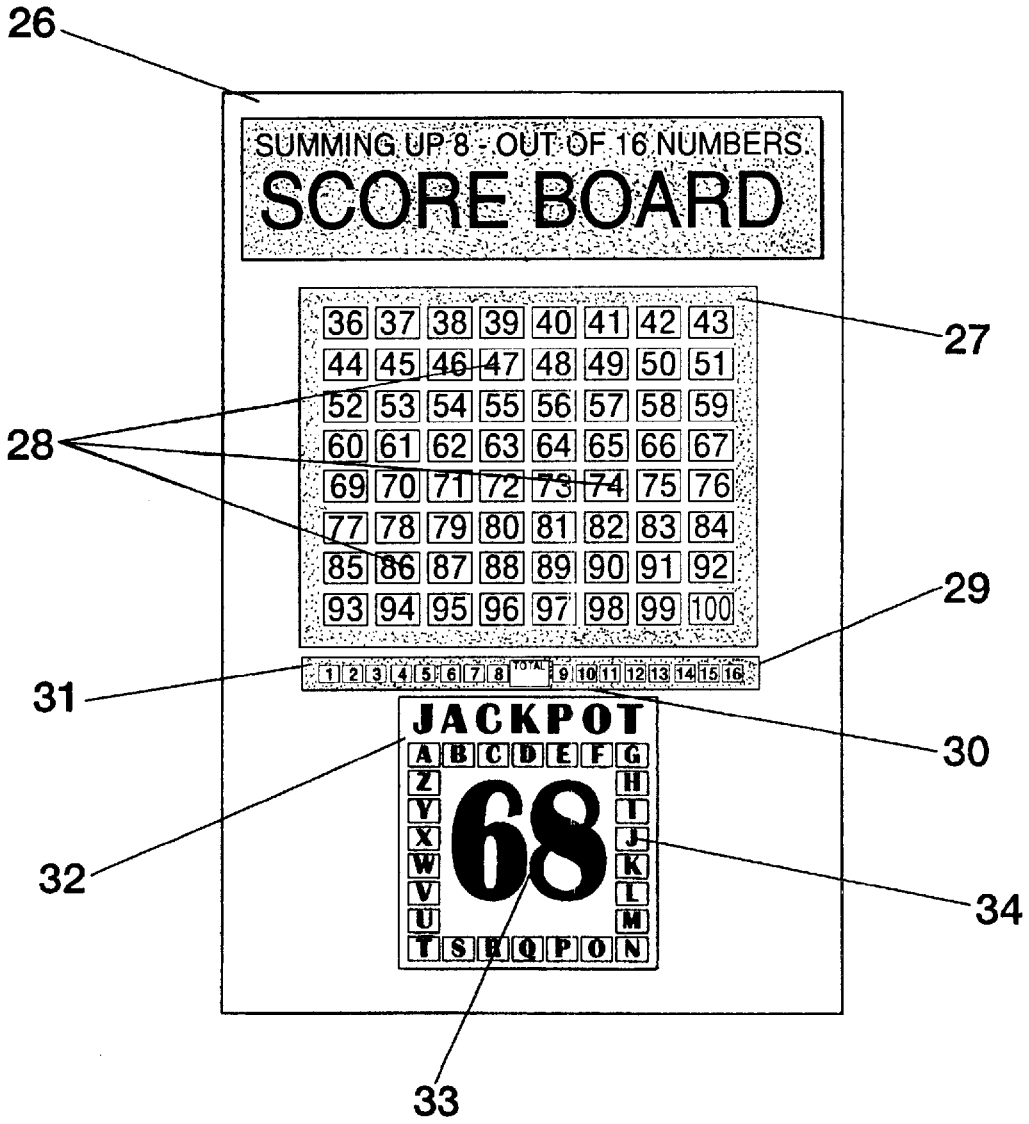
FIG. 3 is a plan view of the present "Summing Up 8-out of-16 numbers" score board invention suitable for a. o. Casino and Television games marked with references 26, 27, . . . 34.

In the embodiment of an extension of the invention illustrated in FIG. 3, a "Summing Up 8-out of-16 numbers" score board 26 is presented that can be exploited in e.g. casino games and Television shows. The score-board 26 is composed of:

a set 28 of mathematical numerals (36, 37, . . . 66, 67, 69, . . . 99, 100) obtained by summing up eight randomly chosen numbers that are individually indicated in boxes 29, a collection of sixty-four numbers 28 representing all possible sums that can be composed out of $\binom{16}{8}$ combinations, a set 31 of sixteen squares representing the sixteen numerals out of which eight numbers 29 are randomly chosen, a set 31 containing one square 30 in the middle labelled "TOTAL" in which the in between results of an addition of a set of numbers 29 is represented discharging into a final sum being one of the numbers 28, a collection 32 labelled "JACKPOT" that integrates one single number 33, coinciding with the sum of eight numbers equalling the numeral 68, with a set 34 of twenty-six squares, grouped around the numeral 68, representing the letters of the alphabet out of which three letters are randomly drawn.

Summing up the lowest eight numbers one through eight executes a sum of 36, while adding up the eight higher numbers nine through sixteen results in a sum of 100. Both diagonals-wise oriented numbers 36 and 100 are members of the set 28 of mathematical obtained numerals (36, 37, . . . 66, 67, 69, . . . 99, 100).

An example will be worked out where the results of a horse-race are assimilated in the "Summing Up 8-out of-16 numbers lottery" during a life broadcasted Television show. The procedure in this hypothetical arranged situation is then as follows. Suppose the first four incoming horses 9, 7, 4 and 8 out of a field of sixteen are nominated as the winners. Upon receiving the broadcasted numbers 9, 7, 4 and 8 from the horse-track the bulbs 51 behind the squares 29, of which the numbers correspond with the numbers of the four winning horses 9, 7, 4 and 8, are kindled.

A few seconds later the bulb behind box 30 labelled "TOTAL" lights up, indicating the in between times acquired sum of the numbers 9, 7, 4 and 8 equals 28.

Simultaneously the contents of an unique computed look-up table previously stored in a Programmable Read Only Memory [PROM] of a PC is searched for the collection of sums that cannot exist any more given the four numbers 9, 7, 4 and 8.

Figure 4:
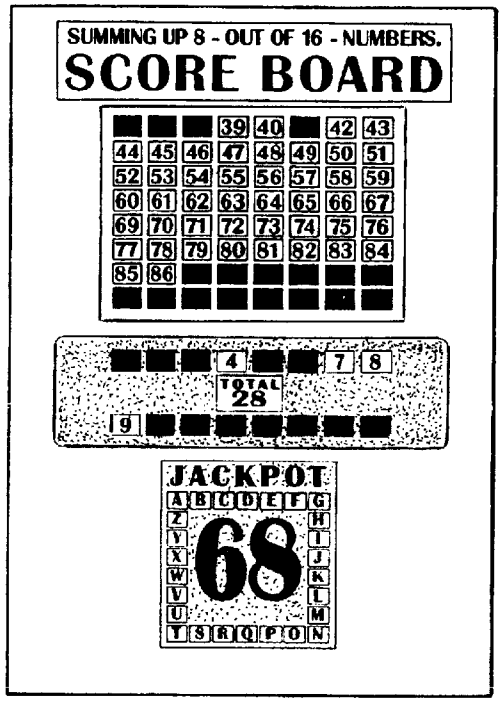
FIG. 4 is a plan view of the present "Summing Up 8-out of-16 numbers" score board invention marked with reference 35, illustrating the phenomenon to put out indicators to some extent according to an exclusion of numbers representing sum(s) of chosen numbers one through sixteen.

Sums that are definitely excluded, given the cluster of four winning numbers 9, 7, 4 and 8, are the following: 36, 37, 38, 41, 87 through 100. The result of the work-out of this example 35, embodying this invention is shown in FIG. 4.

Figure 5:
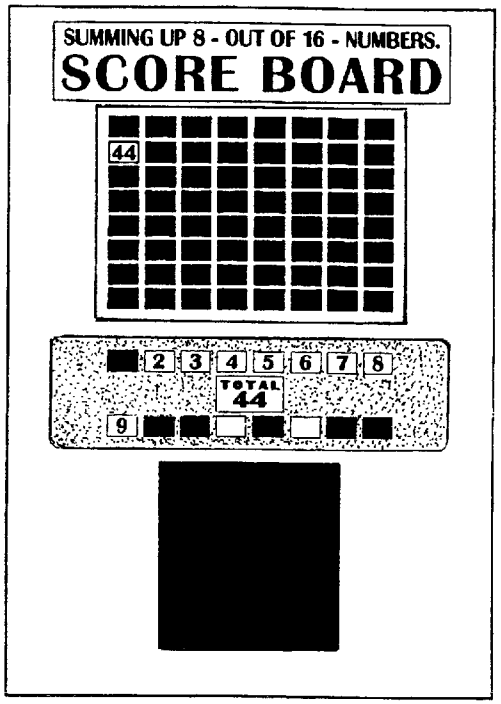
FIG. 5 is a plan view of the present "Summing Up 8-out of-16 numbers" score board invention marked with reference 36, illustrating the phenomenon to completely put out all indicators except for one according to the exclusion of numbers representing sum(s) of chosen numbers one through sixteen.

The phenomenon of lighting up the in this specific example remaining four randomly chosen squares 29 at the same time putting out the bulbs behind the boxes 28 continues until only one bulb 50 behind the boxes 28, corresponding to the only possible sum left given a total of eight winning numbers, remains lighted. Suppose the next four randomly chosen numerals 2, 5, 3 and 6 (descended from a Random Number Generator 44) out of the twelve remaining numerals 1 through 3, 5 and 6, 10 through 16 are nominated the winning numbers. Upon processing the numbers 2, 5, 3 and 6 the bulbs 51 behind the squares 29, of which the numbers correspond with the numbers of the four winning numerals 2, 5, 3 and 6, are kindled. A few seconds later the numeral indicated in the box 30 labelled "TOTAL" alters, indicating the sum of the numbers 9, 7, 4, 8, 2, 5, 3 and 6 equals 44. Simultaneously the contents of the look-up table previously stored in the Programmable Read Only Memory is searched and interrogated for the only possible sum that can exist given the eight numbers 9, 7, 4, 8, 2, 5, 3 and 6. Sums that are now excluded, given the cluster of eight winning numbers 9, 7, 4, 8, 2, 5, 3 and 6, are: 36 through 43 and 45 through 100. The result of the work-out of this example 36, embodying this invention, is shown in FIG. 5.

The essence of this part of the invention is thus the putting out of bulbs 50 behind boxes 28 that correspond to sums that are excluded given an arbitrary drawn of seven out of sixteen numerals, except for the one bulb 28 that corresponds to an unique sum given a total of eight winning numbers out of a total of sixteen numerals.

As a counterpart of the previously elucidated procedure during which bulbs behind boxes 28 are put out according to a random processed sequence of a total of eight numerals that are summed afterwards, the scheme of the part "JACKPOT" 32, however, passes off in a total different way. According to the philosophy of the embodiment of this invention the bulb 53 behind the number 68 is also put out the moment the sum 68 is excluded from winning due to a certain combination of numbers drawn. As a consequence the complete box 32 has become invisible.

Figure 6:
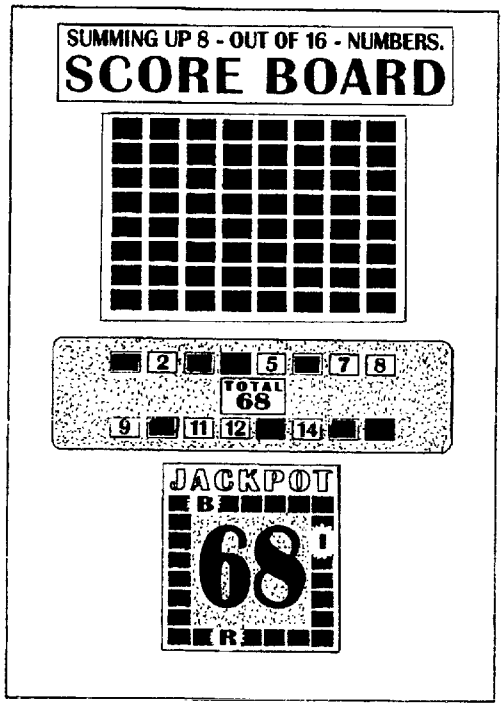
FIG. 6 is a plan view of the present "Summing Up 8-out of-16 numbers" score board invention marked with reference 37, illustrating the phenomenon that all indicators are put out according to the exclusion of numbers representing sum(s) of chosen numbers one through sixteen except for the number 68 expanded with the lighting up of three characters according to a selection of characters out of a total of twenty-six characters representing the complete alphabet.

In case the sum of the eight randomly chosen numbers equals 68 the bulb 53 behind the number 68 is periodically flashed on and off. The procedure now continues with a random draw of three letters 34, the result of which is expressed by lighting up bulbs 53 behind the corresponding boxes 34 of the characters B, I and P. The result of the work-out of this example 37, embodying this invention, is shown in FIG. 6.

The essence of this part of the invention is thus the flashing on and off of the bulb 53 behind box 33 followed by lighting up the bulbs 53 behind the three boxes 34 representing the choice of three randomly chosen letters B, I and R, out of a total of twenty-six letters of the alphabet A through Z in case the sum is 68.

Figure 7:
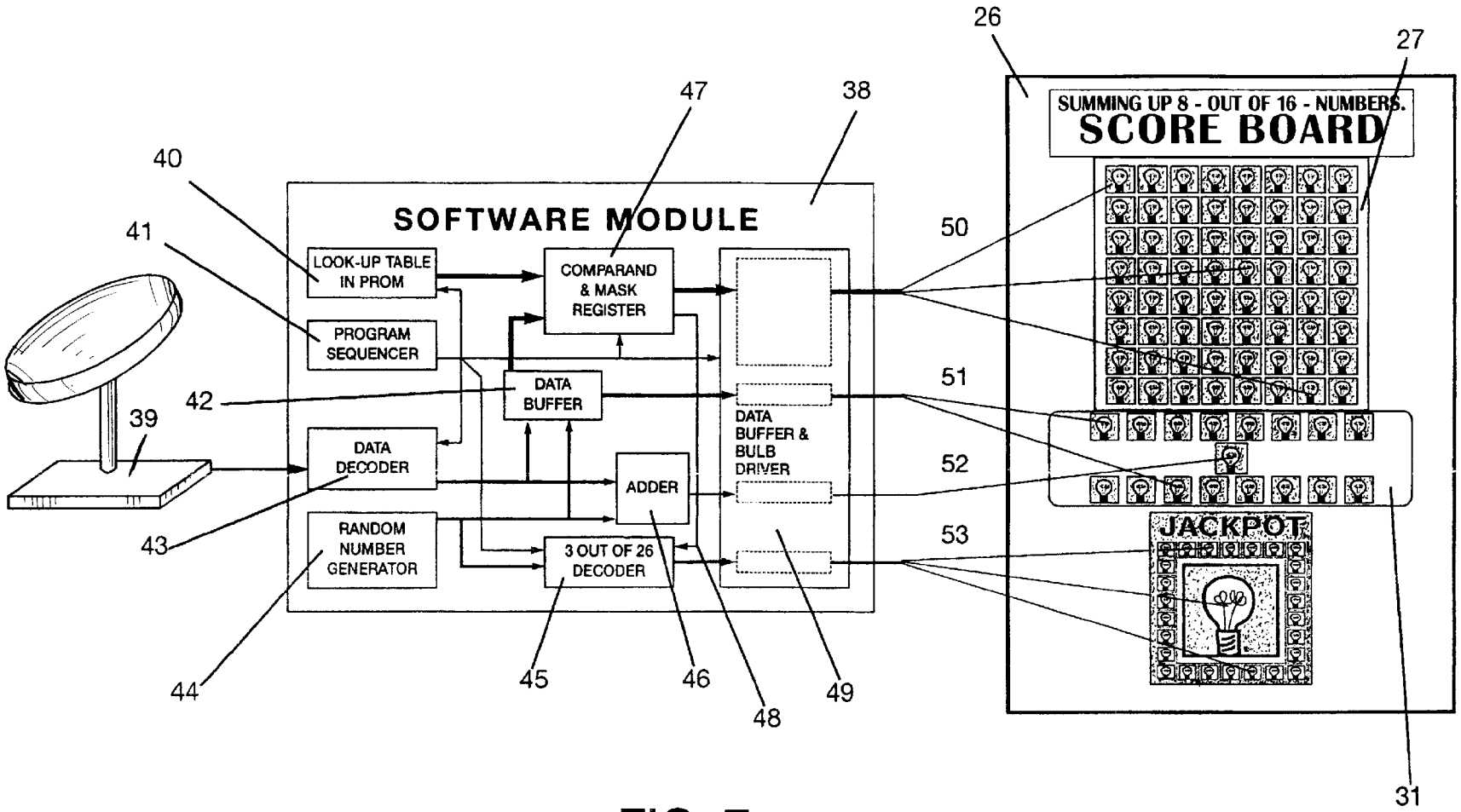
FIG. 7 is a block diagram illustrating a soft- and hardware method to light up the randomly selected numbers eight-out of-sixteen and to put out the sum(s) that are excluded from further participation.

A brief description will be given of a further extension of the embodiment of the invention on the basis of an illustration of the block diagram shown in FIG. 7. In order to be able to maintain integrity of the "Summing Up 8-out of-16 numbers lottery" game on the one hand, at the same time warranting the reliability of a system suitable to allow life broadcasting of a Television show, a software module 38, performing "Functions 40 through 49" is proposed. The description of the process is again based on the example worked out previously in which first the four winning horses 9, 7, 4 and 8 are nominated followed by the results 2, 5, 3 and 6 of the four randomly drawn numerals.

At the start it is assumed that all the bulbs 50 behind squares 28 and the bulb 53 behind square 33 are lighted up. The remaining bulbs 51, 52 and 53 behind respectively the squares 29, 30 and 34 are all extinguished.

After the race has been finished, the last five minutes of the scene of the horse-race are broadcasted and received by an antenna 39 located at the site of a Television studio. After having pre-processed the signal, the received information is directed towards the "DATA DECODER 43". The decoded result—in this case the winning numbers 9, 7, 4 and 8—, produced by the "DATA DECODER 43", is offered to the "DATA BUFFER 42" as well as to the "ADDER 46".

It is further assumed, in conformity with the work-out of the example, that the four randomly chosen numerals 2, 5, 3 and 6 (produced by the "RANDOM NUMBER GENERATOR 44") are next nominated as the last four winning numbers in this specific example. The numbers 2, 5, 3 and 6 are also offered to the "DATA BUFFER 42" as well as to the "ADDER 46". The combined "DATA BUFFER 42" result, containing the numerals 9, 7, 4, 8, 2, 5, 3 and 6, is now available for searching, interrogating, comparing and masking purposes in the "COMPARAND AND MASK REGISTER 47".

The outputs of the "COMPARAND AND MASK REGISTER 47" are linked to the "DATA BUFFER & BULB DRIVER 49". The results, after being stored in the "DATA BUFFER" section of the "DATA BUFFER & BULB DRIVER 49" are now available for the "BULB DRIVER" section to individually manipulate the putting out of clusters of the sixty-four bulbs 50 behind the squares 28 and in case of relevance also the bulb 53 behind square 33. This occurs in conformity with a software protocol that is executed to exclude sums according to numbers that are offered. The software program itself is written in a mixture of C (C: a compiler, in the case considered: Turbo C) and Assembler. The purpose hereof is to maintain processing speed during the work-out of the probabilities of occurrence of the various combinations of winning numbers with respect to their corresponding exclusion of sum(s).

The same procedure is performed on the output of the "ADDER 46", representing the sum of the four winning numbers 9, 7, 4 and 8 of the horse-race and the four remaining randomly chosen numbers 2, 5, 3 and 6 from the "RANDOM NUMBER GENERATOR 44", the result of which is stored and further used to indicate the value of the in between achieved sum and to light up bulb 52 behind square 30 labelled "TOTAL". The result of the outputs of the "DATA BUFFER 42", composed of the overall winning numbers 9, 7, 4, and 8 and 2, 5, 3 and 6, is first feed to the "DATA BUFFER & BULB DRIVER 49" and subsequently used to kindle the in this case corresponding eight bulbs 51 behind squares 29. In the special case in which the final sum is appointed to be 68, a result 48 from the "COMPARAND AND MASK REGISTER 47" is used to enable the "3 OUT OF 26 DECODER 45". Driven by the "RANDOM NUMBER GENERATOR 44" it starts a random sequence during which three out of twenty-six characters are selected. The results, here corresponding with the randomly selected three characters B, I and R, expanded with an acknowledgement that the best out of eight selection has appointed the sum 68, are fed to the four corresponding bulbs 53 behind squares 33 and 34.

Timing to initiate and control the process of appointing the winning numbers and/or letters on the one hand and excluding sum(s) on the other, is synchronised by the commands of the "PROGRAM SEQUENCER 41". The "PROGRAM SEQUENCER 41" is used to initiate multiple activities, like synchronising the incoming information from the "ANTENNA 39" with the processes in the "SOFTWARE MODULE 38", writing data out of the "DATA DECODER 43", fetching data from the "LOOK-UP TABLE 40", enabling and disabling the processes of the "3 OUT OF 26 DECODER 45", clocking data from the "LOOK-UP TABLE 40" and the "DATA BUFFER 42" into the "COMPARAND AND MASK REGISTER 47", continuing search, compare and mask procedures in the "COMPARAND AND MASK REGISTER 47" to exclude combinations of sum(s) according to the winning numbers and/or letters and finally directing the overall results towards the "DATA BUFFER & BULB DRIVER 49".

In a global description of the basic principles it is assumed that all possible combinations, originating from the eight-out of-sixteen selections completed with their individual appointed exclusions of sum(s) and the in between times achieved values of the numbers of sum(s) left, are calculated previously.

Once calculated, controlled and statistically checked, the file containing all the results will be stored in the form of a "LOOK-UP TABLE 40" in a Programmable Read Only Memory in the Software Module 38. An elaboration of the process of selection and exclusion is elucidated in the following described Processing Scheme.

The previously worked out example of the four winning numbers 9, 7, 4 and 8 of the horse-race completed with the four randomly drawn numbers 2, 5, 3 and 6 from the "RANDOM NUMBER GENERATOR 44" will officiate as a basis for a more detailed description. The sense of the column, labelled "NUMBERS 1 THROUGH 16" is replaced by a representation of bits "1 through 16" for ease of explanation.

In the Processing Scheme shown, the symbols "◇", "" and "●" have the following significance. "◇" guarantees transparency. Transparency here implies a situation in which the "◇" labelled bits are still available for selection in the next draw during which another randomly chosen winning number has to be selected.

"", representing its counterpart—untransparency—, indicates bit positions that have been appointed during the sequence of a previous draw. After memorising and storing the bit pattern, performed and composed in the "COMPARAND AND MASK REGISTER 47", the function of the bits corresponding with the positions of "" —untransparency—will pass into another status "●"—a don't care situation.

The significance of a composition of such a bit mask pattern, wherein writing of a bit in the positions that are indicated by the symbol "●" has become superfluous, is to enable a fast search procedure on the basis of ignoring the bits that are already indicated by the symbol "●".

The moment any arbitrary combination of numbers, varying from at least one to at the most eight, is offered to be classified in terms of exclusions of sum(s) a built-in software protocol initiates a searching, comparing and selecting procedure by interrogating the contents of the "LOOK-UP TABLE 40" that was stored in the Programmable Read Only Memory in the "SOFTWARE MODULE 38".

A software mask is generated, each time one or multiple winning number(s) are drawn.

PROCESSING SCHEME

| NUMBERS 1 THROUGH 16 | REMAINING SUMS | NUMBER OF SUMS THAT ARE EXCLUDED | COMPARE & MASK PROTOCOL |
|---|---|---|---|
| DRAW 9, 7, 4, 8<br>. . . x . . x x x . . . . . | 47 | 36 37 38 ● ● 41 ● ● ●

The contents of the "LOOK-UP TABLE 40" consists of three columns containing data of all possible combinations of an eight-out of-sixteen bit selection (the "NUMBERS 1 THROUGH 16" column), the matching results shown in the "REMAINING SUM(S)", column and an array of numbers representing all the "NUMBERS OF SUM(S) THAT ARE EXCLUDED". The various compare and mask patterns are shown in the most right column, labelled "COMPARE AND MASK PROTOCOL". Each unique bit pattern, representing a combination out of the "NUMBERS OF SUM(S) THAT ARE EXCLUDED", is then used for further searching and masking purposes.

The very first initiative, shown under the header "DRAW 9, 7, 4, 8" of the Processing Scheme, is to start up the procedure to characterise and classify the participating bits ". . . x . . xx x . . . . . "; here represented by the winning numbers of the four first incoming horses. Next a bit pattern "◇ ◇ ◇ ◆ ◇ ◇ ◆ ◆ ◆ ◇ ◇ ◇ ◇ ◇ ◇ ◇", representing the positions of the first four winning numbers 9, 7, 4 and 8, is generated by the "DATA BUFFER 42". This pattern together with the read-out of the contents of the "LOOK-UP TABLE 40" is offered to the "COMPARAND AND MASK REGISTER 47". During execution of the software program all the combinations stored in the column "NUMBERS 1 THROUGH 16" are compared with the bit pattern "◇ ◇ ◇ ◆ ◇ ◇ ◆ ◆ ◆ ◇ ◇ ◇ ◇ ◇ ◇ ◇". Matching of the two data streams results in an array of sum(s), the values of which are further excluded from participation. These values are shown in the column "NUMBERS OF SUMS THAT ARE EXCLUDED". A new bit mask pattern "◇ ◇ ◇ ● ◇ ◇ ● ● ● ◇ ◇ ◇ ◇ ◇ ◇ ◇", indicating both remaining transparencies "◇" and don't cares "●", originates.

This bit pattern shown in the column labelled "COMPARE AND MASK PROTOCOL", is memorised and stored in the "COMPARAND AND MASK REGISTER 47" to function as a software mask for the next processing step.

The purpose of the generation of such a bit mask pattern is multiple: it makes the search for the bits 9, 7, 4 and 8 superfluous in the next processing step and it associates the specific combination 9, 7, 4 and 8 with the corresponding values of the previously calculated sum(s). These sum(s) are now excluded from further contribution. The numerals of the sum(s) that are excluded are listed in the third column, labelled "NUMBERS OF SUMS THAT ARE EXCLUDED". Also indicated in the second column is a number for the remaining sum(s): in this case: 47.

The next step is to integrate and compare the results "◇ ◆ ◇ ◇ ◇ ◇ ◇ ◇ ◇ ◇ ◇ ◇ ◇ ◇ ◇ ◇" of the second drawing, labelled "DRAW 2", with the previously composed bit mask pattern "◇ ◇ ● ◇ ◇ ● ● ● ◇ ◇ ◇ ◇ ◇ ◇ ◇ ◇". The actual search time is now shorter because of the fact that the numbers 9, 7, 4 and 8 do not contribute any more and thus do not influence a search for their respective positions. This is a direct consequence of the influence of the don't care ("●") bits. There are 35 sum(s) left (see column 2) and it is obvious that the amount of sum(s) that are now excluded do increase. A new bit mask "◇ ● ◇ ● ◇ ◇ ● ● ● ◇ ◇ ◇ ◇ ◇ ◇ ◇" originates.

The execution of the software protocol proceeds until (in the case of this specific example) the bit mask pattern "◇ ● ● ● ● ◇ ● ● ● ◇ ◇ ◇ ◇ ◇ ◇ ◇ ◇", resulting from the fourth drawing, labelled "DRAW 3", is reached. There are yet 9 sums left and the number of the to be compared bits has now decreased to one. It is shown in the overview of the "NUMBERS OF SUMS THAT ARE EXCLUDED" column, that the only sum left (X) is 44.

In case it occurs that the processing time of the overall software protocol is not neglectful any more with respect to the time intervals of the different play moments in a Television show, a "Special Purpose Hardware System" has to be designed. The task of this "Special Purpose Hardware System", supporting a functionality that is identical to that of the "SOFTWARE MODULE 38" is twofold. It speeds up the tracking, analysing and processing activities to search, interrogate, compare and mask the contents of the "LOOK-UP TABLE 40". It directly relates the result of any eight-out of-sixteen combination with the corresponding sums that are further excluded from contribution.

The features of this "Special Purpose Hardware System" shall not be discussed.

We claim:

1. A method of playing a game of chance, wherein a plurality of m winning symbols is randomly drawn from a set of n play symbols (1–16), the method comprising the steps of:

each player selecting at least one stake indicia (28) from a first set of stake indicia (27), each stake indicia representing a predetermined collection of one or more combinations of play symbols from said set of n play symbols;

randomly drawing a group of m winning play symbols from said set of n play symbols (1–16);

comparing said combination of said m winning play symbols to the selected stake indicia;

selecting a further stake indicia from a second set of stake indicia (32), each further stake indicia representing a further combination of play symbols from said set of n play symbols not used in said first set of stake indicia (27) and one or more winning play symbols out of a predetermined collection of further play symbols (A–Z);

randomly drawing one or more said further play symbols from said predetermined collection of further play symbols (A–Z); and comparing said further combination of said winning play symbols to the selected stake indicia.

2. The method of claim 1, wherein said further combination of play symbols not used in the first set of stake indicia (27) have the highest probability of being drawn.

3. The method of claim 1, wherein said play symbols are numbers and said further play symbols are letters.

4. The method of claim 1, wherein the play symbols are the numbers of the participants of a race and the winning play symbols are the winning numbers.

5. The method of claim 1, further comprising a play slip suitable for the method of playing a game of chance according to claim 1, wherein said one or more combinations of said play symbols are associated to respective boxes printed on the play slip and selectable by a player, a second set of indicia (7, 8, 9), each indicium representing a further combination of play symbols being not used in the first set of stake indicia (5, 6, 10) and wherein said one or more winning play symbols out of a predetermined collection of further play symbols (A–Z) are associated to boxes printed on the play slip and selectable by a player.

6. The method of claim 5, wherein said further combination of play symbols not used in the first set of stake indicia (27) have the highest probability of being taken.

7. The method of claim 5, wherein said play symbols are numbers and said further play symbols are letters.

8. The method of claim 5, wherein the play symbols are the numbers of the participants of a race and the winning play symbols are the winning numbers.

9. The method of claim 5, wherein the slip comprises time indicia (14) representing a time prior to the drawing of said winning symbols; date indicia (11) representing a date prior to the drawing of said winning play symbols; place indicia (15) indicating the place where the play slip has been offered prior to the drawing of said winning symbols; selection indicia (12) indicating play symbols and the combination of play symbols prior to the drawing of said winning play symbols; and dues paid indicia (13) indicating the costs.

10. The method of claim 1, further comprising a score board suitable for the method of playing a game of chance according to claim 1, and further comprising the steps of providing the board with a first field (27) having positions associated to a combination of possible groups of winning play symbols except at least one possible group (33) and a second field (32) having a position associated to the excluded groups and positions associated to further play symbols (A–Z); and indicating the winning group of play symbols.

11. The method of claim 10, wherein the excluded at least one group (33) of winning play symbols has the highest probability of being drawn.

12. The method of claim 10, wherein the said n play symbols are numbers and the further play symbols are letters.

13. The method of claim 10, wherein the said n play symbols are the numbers of the participants of a race and the winning symbols are the winning numbers.

14. The method of claim 10, wherein the step of indicating comprises the steps of lighting up a winning group indication in the respective position in the first (27) or second (32) field and a winning further play symbol indication in the respective position of the second field.

15. The method of claim 10, wherein the step of indicating comprises the steps of lighting up all of the group indications in the respective positions of the first field (27) and turning off all of the group indications in the respective positions of the second field (32) and the further play symbol indications (A–Z) in the second field (32) before drawing the winning symbols and turning off the non-possible group indications in the first field (27) after each drawing of a winning symbol; lighting up the group indications in the respective positions of the second field (32) when the respective winning symbols have been drawn; and lighting up the winning further play symbols.

16. The method of claim 14, wherein the steps of lighting up and turning off the group and further symbol indications comprises the steps of:

recognizing the status of the play symbols according to a draw of a group of winning play symbols from the set of play symbols (1–16);

appointing correlations between combinations of play symbols according to a draw of a group of winning symbols from the set of play symbols (1–16);

executing a software program on play symbols according to a draw of a group of winning play symbols from the set of play symbols, resulting in the exclusion of groups and further symbols.

17. The method of claim 10, wherein a third field (31) is provided for lighting up the winning symbols or a combination thereof.

18. The method of claim 10, wherein the lighting up of at least the winning group indication or winning further symbol indication is in a flashing way.

* * * * *